US006106065A

United States Patent [19]

Carroll

[11] Patent Number: 6,106,065

[45] Date of Patent: Aug. 22, 2000

[54] EXAMINATION CHAIR WITH LIFTING AND TILTING MECHANISM

[75] Inventor: Robert M. Carroll, Cincinnati, Ohio

[73] Assignee: Reliance Medical Products, Inc., Mason, Ohio

[21] Appl. No.: 09/177,808

[22] Filed: Oct. 23, 1998

Related U.S. Application Data

[60] Provisional application No. 60/063,113, Oct. 24, 1997.

[51] Int. Cl.[7] ..... A47C 1/02; A61G 15/00

[52] U.S. Cl. ..... 297/330; 297/325; 297/329

[58] Field of Search ..... 297/330, 325, 297/329

[56] References Cited

U.S. PATENT DOCUMENTS

| | | | |
|---|---|---|---|
| D. 300,657 | 4/1989 | Simpkins et al. . | |
| D. 333,736 | 3/1993 | Nordstrom . | |
| D. 354,176 | 1/1995 | Schwaegerle et al. . | |
| D. 354,177 | 1/1995 | Schwaegerle et al. . | |
| D. 379,409 | 5/1997 | Schwaegerle et al. . | |
| 2,874,689 | 2/1959 | Gavelek . | |
| 3,198,574 | 8/1965 | Ota et al. | 297/191 |
| 3,299,886 | 1/1967 | Mikan . | |
| 3,578,379 | 5/1971 | Taylor et al. | 297/71 |
| 3,999,799 | 12/1976 | Daswick | 297/270 |
| 4,415,203 | 11/1983 | Cawley | 297/391 |
| 4,505,514 | 3/1985 | Stöckl et al. | 297/322 |
| 4,572,573 | 2/1986 | Yoshikawa et al. | 297/330 |
| 4,852,941 | 8/1989 | Jones . | |
| 4,941,709 | 7/1990 | Möller | 297/325 |
| 4,957,302 | 9/1990 | Maxwell | 280/32.6 |
| 4,993,777 | 2/1991 | LaPointe | 297/325 |
| 5,061,010 | 10/1991 | LaPointe | 297/325 |
| 5,108,202 | 4/1992 | Smith | 297/330 |
| 5,215,351 | 6/1993 | Lapointe | 297/325 |
| 5,249,838 | 10/1993 | Kulpa et al. | 297/328 |
| 5,294,179 | 3/1994 | Rudes et al. | 297/330 |
| 5,348,375 | 9/1994 | Steininger | 297/362.11 |
| 5,461,965 | 10/1995 | Schwaegerle . | |
| 5,467,002 | 11/1995 | Brooks . | |
| 5,520,439 | 5/1996 | Blount | 297/330 |
| 5,624,159 | 4/1997 | Celoni et al. . | |
| 5,628,546 | 5/1997 | Boetzkes . | |
| 5,645,313 | 7/1997 | Best et al. | 297/330 |

FOREIGN PATENT DOCUMENTS

| | | |
|---|---|---|
| 3110111 | 3/1981 | Germany . |

OTHER PUBLICATIONS

Reliance Medical Products, Inc., *920 Manual Tilt Chair with Power Hydraulic Base,* Brochure, 1993.

Reichert Ophthalmic Instruments, *The Premier Advanced Positioning System,* Brochure, Oct. 1991.

Reliance Medical Products, Inc., *0920 Tilt Chair,* Engineering Drawings, 3 sheets, Sep. 1990.

Marco Ophthalmic, *Marcotilt Chair,* Brochure.

Topcon Corporation, *Ophthalmic Chair OC–20T,* Brochure.

American Optical Corporation, *planning ahead . . . for your AO Custom Chair and Stand,* Brochure.

Reliance Medical Products, Inc., *7100, Fully powered, minor procedures table,* Brochure, 1994.

Reliance Medical Products, Inc., *7000, Fully powered hydraulic examination chair/minor procedures table,* Brochure, 1993.

Reliance Medical Products, Inc., *Introducing the premier package for RK surgery,* Brochure.

Reliance Medical Products, Inc., *Surgical Package,* Brochure, 1993.

Reliance Medical Products, Inc., *880, Fully powered hydraulic examination chair/procedures table,* Brochure, 1995.

*Primary Examiner*—Anthony D. Barfield

*Attorney, Agent, or Firm*—Wood, Herron & Evans, L.L.P.

[57] ABSTRACT

A lift and tilt chair including both motorized lift capability and motorized tilting capability. A hydraulic lift cylinder is provided and operates in conjunction with a motorized tilting system. A seat support is provided having rollers affixed thereto for providing the tilting motion and having the lift cylinder attached thereto for allowing raising and lowering of a patient seated within the chair.

7 Claims, 3 Drawing Sheets

EXAMINATION CHAIR WITH LIFTING AND TILTING MECHANISM

This application claims the benefit of U.S. Provisional Application No. 60/063,113 filed Oct. 24, 1997.

FIELD OF THE INVENTION

The present invention generally relates to medical chairs and, more specifically, to chairs that may be moved by a medical professional to place a patient in a desired position.

BACKGROUND OF THE INVENTION

Many different types of chairs have been developed in the medical field for placing patients in a desired position for treatment or diagnosis. These include dental chairs and ophthalmological chairs. One such chair is disclosed in U.S. Pat. No. 5,467,002, assigned to the assignee of the present invention, the disclosure of which is hereby fully incorporated by reference herein. The chair disclosed in this patent has the ability to raise and lower a patient seated within the chair and also the ability to recline the patient and raise the patient's feet by way of a pivoting backrest, leg rest and footrest. Often, it is desirable to simply tilt the patient back while leaving the patient in essentially the same seated position. Such chairs are typically referred to as "tilt chairs". Various tilt chairs have been proposed in the past, however, no chair to date has adequately and efficiently allowed a medical professional to both tilt a patient into position and raise or lower the patient during or after diagnosis or treatment.

For these and other reasons, it would be desirable to provide a tilt chair which is cost efficient in design, yet may be used by a medical professional to both tilt a patient automatically into position and raise or lower that patient into the ultimately desired position.

SUMMARY OF THE INVENTION

To these ends, the present invention provides a medical chair having a patient support generally affixed to a base by a lifting and tilting mechanism. The lifting and tilting mechanism generally comprises a seat support having four rollers mounted thereon and contained within slots respectively contained in a pair of support rails affixed to the back of the patient support. A pair of rollers is mounted to the front of the seat support and a pair is mounted to the rear thereof. The slots are curved to define the tilting path of the chair. The lifting and tilting mechanism further includes a lifting cylinder rigidly affixed to the seat support between the front and rear pairs of rollers. This lifting cylinder is connected to a motorized hydraulic pump contained in the base of the chair. An actuator is affixed between the patient support and the seat support for moving the patient support relative to the seat support by movement of the rails along the front and rear pairs of rollers. Significantly, the front and rear pairs of rollers are mounted to the seat support in generally the same horizontal plane for stability, ease of manufacture and proper movement of the rollers within the guide slots.

It will be appreciated that the invention provides a chair that may have a single foot control for use by a medical professional to provide powered movement both in a tilting manner and a vertical direction to adjust the position of a patient undergoing diagnosis or treatment. The invention further provides such advantage in a cost efficient manner due to the integrated design of the lifting and tilting mechanism. Additional advantages and objects of the invention will become more readily apparent to those of ordinary skill upon review of the following detailed description of the preferred embodiment taken in conjunction with the accompanying drawings.

DETAILED DESCRIPTION OF THE PREFERRED EMBODIMENTS

Figure 1:
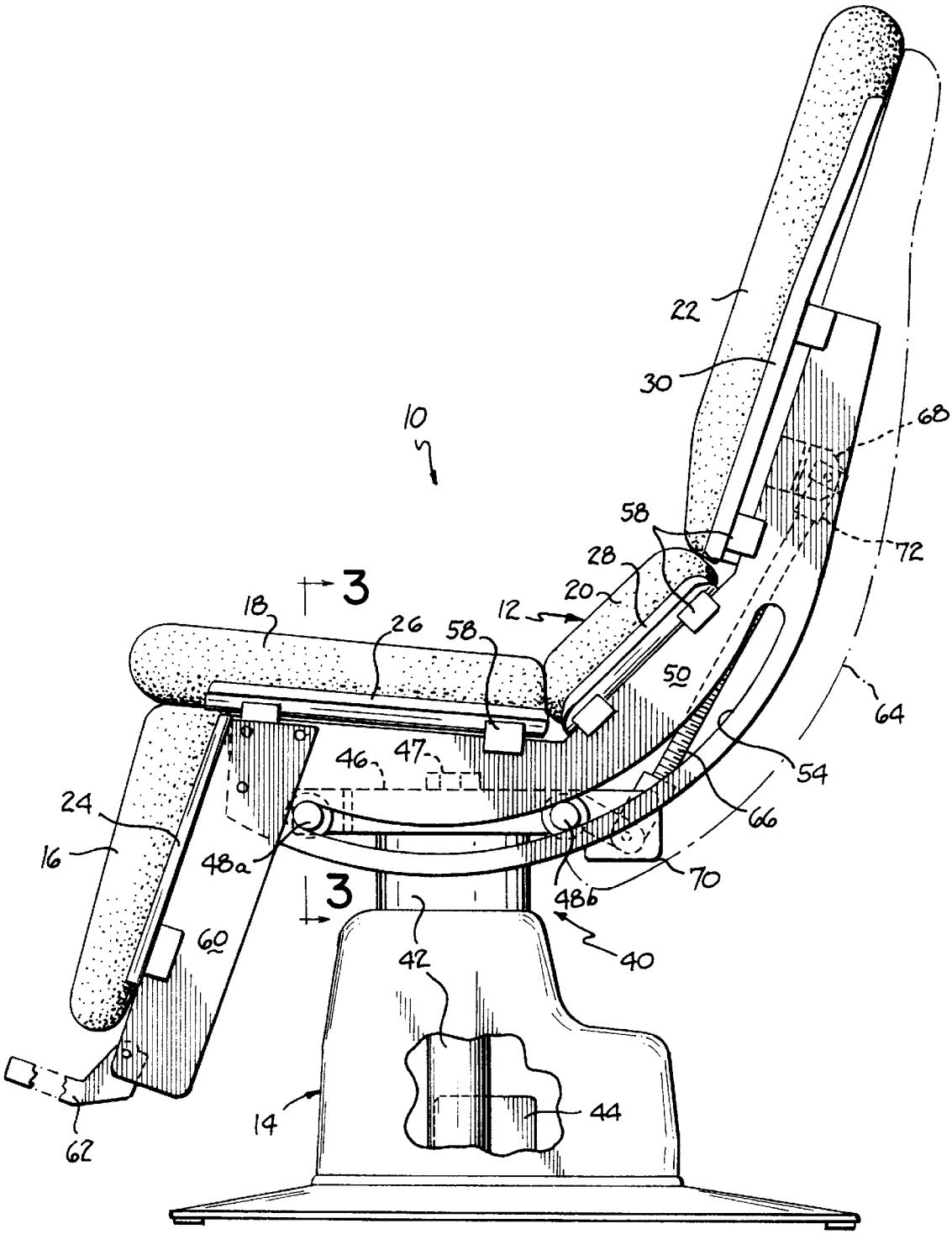
FIG. 1 is a side elevational view of a chair constructed in accordance with the invention, but having certain conventional items, such as the arm rests, removed for clarity.

FIG. 1 illustrates a chair 10 constructed in accordance with a preferred embodiment of this invention. Chair 10 generally comprises a patient support 12 affixed to a base 14 for both tilting and raising or lowering with respect thereto as will be described. Patient support 12 comprises cushions 16, 18, 20, 22 that are respectively attached to flat support members 24, 26, 28, 30.

Figure 2:
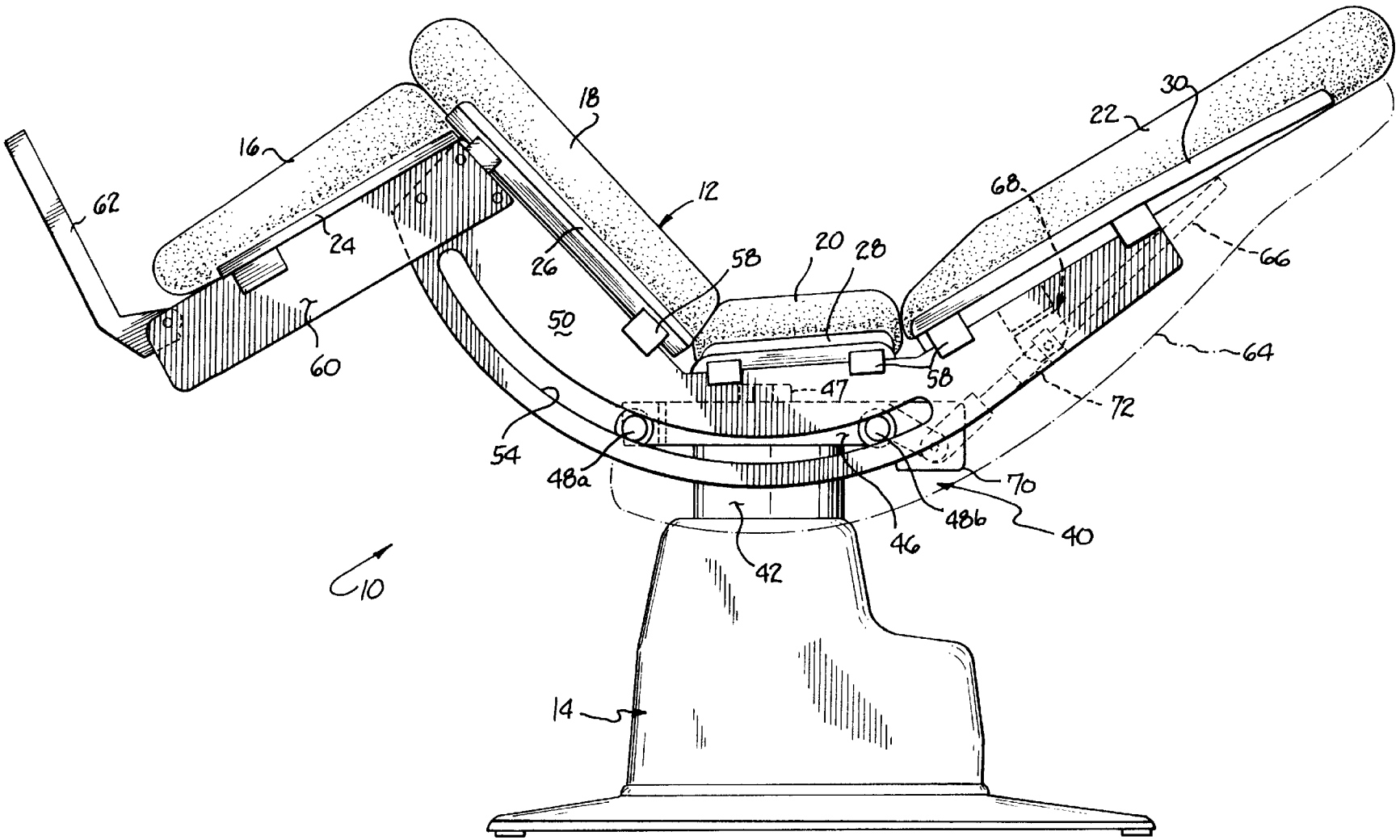
FIG. 2 is a side elevational view similar to FIG. 1 but showing the chair in a tilted position.
Figure 3:
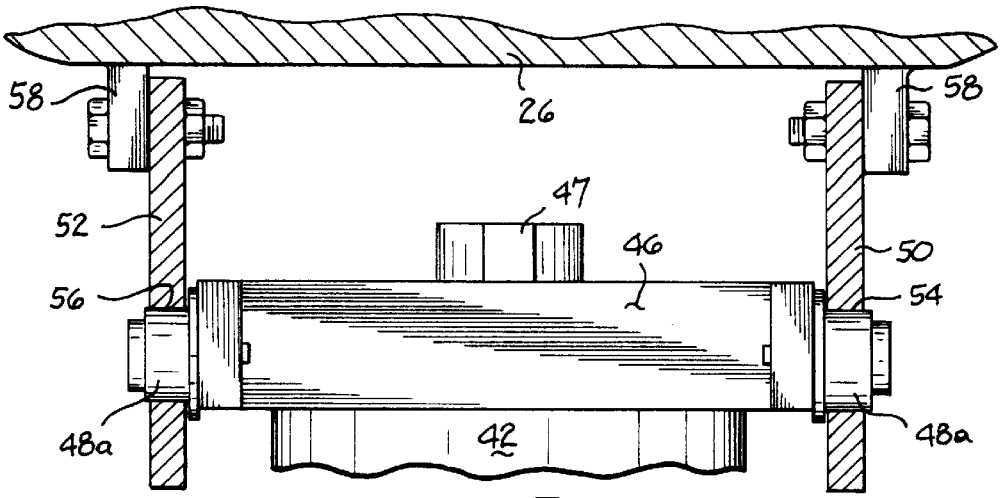
FIG. 3 is a cross section view of the chair illustrated in FIG. 1 taken along line 3—3 thereof.

As shown in FIGS. 1 and 2, a lifting and tilting mechanism 40 generally connects patient support 12 to base 14. Specifically, a lift cylinder 42 extends from base 14 and is operatively connected to a motorized hydraulic pump 44 as generally described in the above incorporated U.S. Pat. No. 5,467,002. Generally, such hydraulic cylinders are known in the art and take many forms. A suitable hydraulic lift mechanism is fully described in U.S. Pat. No. 5,461,965, assigned to the assignee of the present invention and hereby fully and expressly incorporated by reference herein. Cylinder 42 is attached to a seat support 46 by a nut 47. As shown in FIGS. 1–3, front and rear pairs of rollers 48*a*, 48*b* are affixed for rotation relative to seat support 46. As specifically shown in FIGS. 1 and 2, front and rear pairs of rollers 48*a*, 48*b* have two common axes that are each contained in generally the same horizontal plane. Rollers 48*a*, 48*b* are also connected for rolling movement along rails 50, 52. Specifically, rollers 48*a*, 48*b* are contained within respective curved slots 54, 56 of rails 50, 52. Slots 54, 56 are closed end slots and the ends thereof may define the limits of movement, respectively, of front and rear rollers 48*a*, 48*b*.

As also shown in FIGS. 1 and 2, connector blocks 58 connect rails 50, 52 to respective seat support members 26, 28, 30. Side supports 60 (only one shown in FIGS. 1 and 2) are also rigidly affixed to rails 50, 52 and connect a footrest 62 pivotally at the lower end thereof. A cover 64, shown in phantom in FIGS. 1 and 2, may be used to conceal the various mechanical hardware of chair 10 at the rear.

Figure 4:
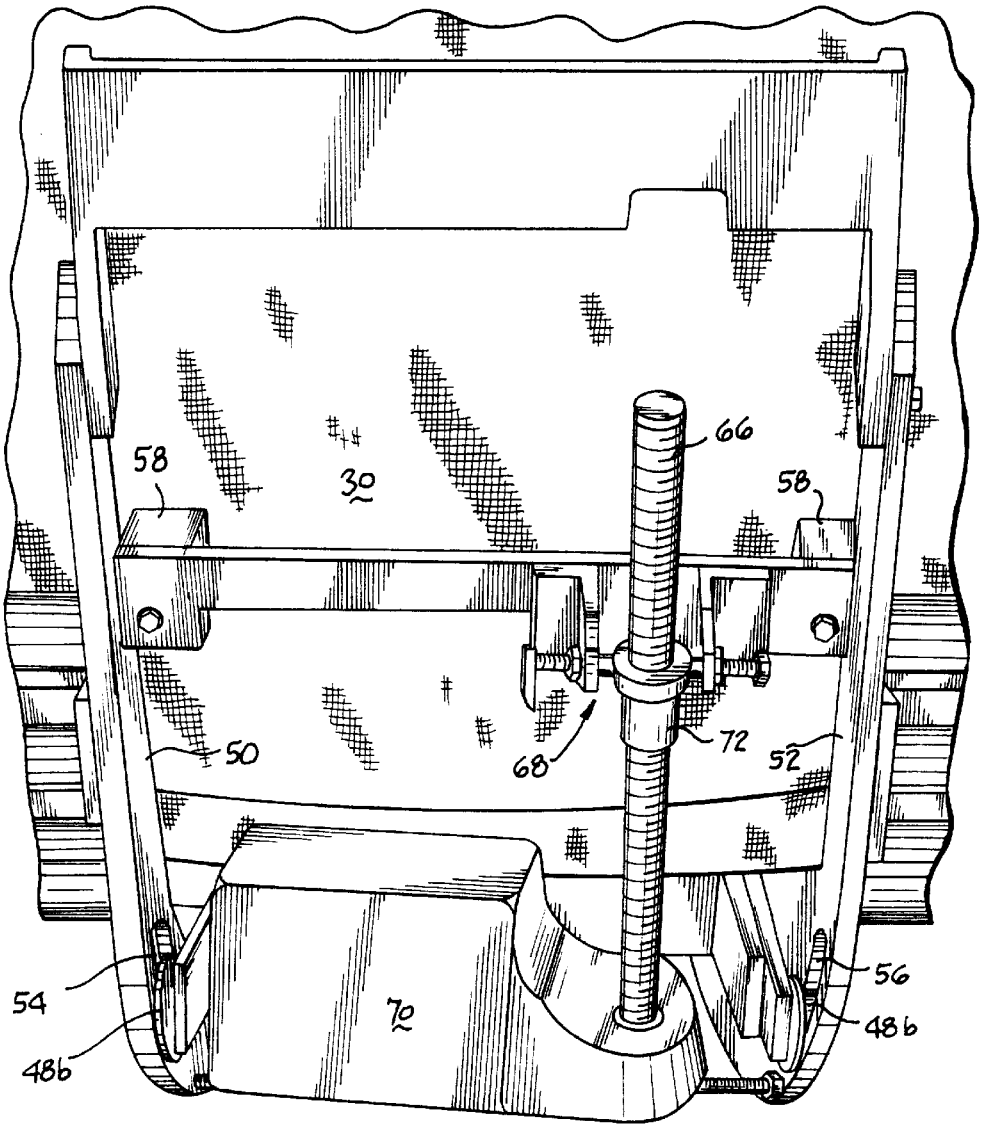
FIG. 4 is a rear perspective view of the chair shown in FIG. 1.

Now referring to FIG. 4, the actuating mechanism for tilting the patient support 12 with respect to base 14 includes a threaded rod or drive screw 66 and a drive nut 72 attached via a pivot 68 mounted generally at the rear side of support member 30 and a motor 70 which may rotatably operate a worm drive (not shown) that is in meshed relation to threaded rod 66 in a conventional manner. Operation of motor 70 by conventional controls will cause rotation of the worm drive and rotation of threaded rod 66 within drive nut 72. A reversible motor is used to allow rotation of threaded rod 66 in either direction. It will be appreciated that rotation of threaded rod 66 will cause drive nut 72 and therefore patent support 12 to travel up and down threaded rod 66 as rails 50, 52 move along the respective front and rear rollers 48*a*, 48*b* following curved slots 54, 56.

It will further be appreciated that conventional controls may be used operate motorized pump 44 and reversible motor 70 and that a foot switch box (not shown) may be provided with multiple switches for depression by the operator to respectively raise and lower the chair by operating motorized pump 44 and tilt patient support 12 by operation of motor 70. The limits of travel for both the lifting and tilting operations may be controlled in conventional fashion. One preferred manner of controlling the tilting travel is to use a nut 72 that will continue to allow threaded rod 66 to rotate at the end of the travel. A timer may then be used in the control system to stop motor 70.

While a preferred embodiment has been described, Applicant does not intent to be bound by the details associated with that preferred embodiment, but only by the scope of any claims ultimately granted in a patent.

What is claimed is:

1. An electrically powered tilt and lift chair for use in medical and dental procedures, the chair comprising:

a patient support including seat and back support surfaces attached in fixed relation with respect to one another for accommodating a patient and including first and second curved roller tracks;

a base including a lift mechanism with a raising and lowering element for raising and lowering the patient support;

a seat support member connected to the patient support below the seat support surface and further connected to the raising and lowering element of the lift mechanism;

rollers operatively coupled with the seat support and connected for rolling movement along the first and second curved roller tracks;

a linear drive member connected to said patient support for pivotal movement behind said back support surface;

a first electric motor coupled to said linear drive member, for moving the linear drive member in a manner that drives the patient support in an arcuate path along the rollers to simultaneously tilt the seat and back support surfaces while said seat and back support surfaces are in the fixed relation; and a second electric motor coupled with the lift mechanism for allowing raising and lowering of the patient support.

2. The chair of claim 1 further comprising:

two pairs of rollers operatively coupled with the seat support and mounted for rotational movement in generally the same plane.

3. The chair of claim 1, wherein the lift mechanism is operatively mounted to a location on the seat support between the rollers.

4. The chair of claim 3, wherein the lift mechanism includes a hydraulic cylinder.

5. The chair of claim 1, wherein the roller tracks further include a pair of plates with closed end, curved slots receiving the rollers.

6. The chair of claim 1, wherein the support surfaces include cushions disposed at three different angles for respectively supporting lower, intermediate, and upper portions of a patient.

7. The chair of claim 1, wherein said linear drive member further comprises a threaded rod having an upper portion pivotally connected to said patient support and a lower portion coupled to said first electric motor, said upper portion being received in an internally threaded drive nut, whereby said first electric motor rotates the threaded rod within the drive nut to move the patient support along said arcuate path.

* * * * *